US008074666B2

(12) United States Patent
Piao

(10) Patent No.: US 8,074,666 B2
(45) Date of Patent: Dec. 13, 2011

(54) BRUSHES WITH INTERCHANGEABLE HEADS

(75) Inventor: Xianzhen Piao, Tianjin (CN)

(73) Assignee: Anisa International, Inc., Atlanta, GA (US)

( * ) Notice: Subject to any disclaimer, the term of this patent is extended or adjusted under 35 U.S.C. 154(b) by 648 days.

(21) Appl. No.: 11/975,808

(22) Filed: Oct. 22, 2007

(65) Prior Publication Data

US 2008/0283083 A1 Nov. 20, 2008

(30) Foreign Application Priority Data

May 14, 2007 (CN) ..... 2007 2 0096006

(51) Int. Cl.
*A45D 44/18* (2006.01)

(52) U.S. Cl. ..... 132/313

(58) Field of Classification Search ..... 132/313, 132/200; 403/DIG. 1, 1; 206/818; 16/422, 16/413, 406; 224/183
See application file for complete search history.

(56) References Cited

U.S. PATENT DOCUMENTS

| | | | | |
|---|---|---|---|---|
| 2,540,340 | A | 2/1951 | Linblade | |
| 2,697,642 | A * | 12/1954 | Rudy | 403/410 |
| 2,725,038 | A | 11/1955 | Owen | |
| 2,866,993 | A | 1/1959 | Edelstone | |
| 3,363,775 | A | 1/1968 | Shaw | |
| 4,811,445 | A * | 3/1989 | Lagieski et al. | 15/104.94 |
| 4,826,059 | A | 5/1989 | Bosch et al. | |
| 4,927,281 | A | 5/1990 | Gueret | |
| 5,063,947 | A | 11/1991 | Gueret | |
| 5,107,984 | A | 4/1992 | Welschoff | |
| 5,165,760 | A | 11/1992 | Gueret | |
| 5,339,483 | A | 8/1994 | Byun | |
| 5,482,059 | A | 1/1996 | Miraglia | |
| 6,035,865 | A | 3/2000 | Krieger | |
| 6,070,597 | A * | 6/2000 | Motherhead | 132/262 |
| 6,189,697 | B1 | 2/2001 | Davis | |
| 6,283,298 | B1 | 9/2001 | Seidler | |
| 6,516,555 | B2 | 2/2003 | Buzzell | |
| 6,532,970 | B2 | 3/2003 | Phue | |
| 6,546,937 | B2 | 4/2003 | Gueret | |
| 6,588,958 | B1 | 7/2003 | Seidler | |

(Continued)

FOREIGN PATENT DOCUMENTS

CN 201067174 6/2008

(Continued)

OTHER PUBLICATIONS

International Search Report and Written Opinion dated Mar. 26, 2010, PCT Application No. PCT/US2009/004143.

(Continued)

*Primary Examiner* — Todd Manahan
*Assistant Examiner* — Brianne O'Neill
(74) *Attorney, Agent, or Firm* — Alston & Bird LLP

(57) ABSTRACT

One embodiment of a head-switchable brush, comprises a brush head, a ferrule, and a brush handle. The ferrule has the head at one end and the handle at the other end. There is a piece of magnet attached to the brush handle and ferrule respectively where the two parts connect. The brush head can be switched and assembled with the handle easily whenever needed. The ferrule can be kept firmly on the handle by the action of the magnet inside. The head-switchable function of this brush kit can greatly enlarge the brush applying space and also avoid the material wasting since this brush kit has one handle only but with various brush head.

17 Claims, 4 Drawing Sheets

U.S. PATENT DOCUMENTS

| | | | | |
|---|---|---|---|---|
| 6,591,842 | B2 | 7/2003 | Gueret | |
| 6,669,389 | B2 | 12/2003 | Gueret | |
| 6,681,936 | B2 | 1/2004 | Godshaw et al. | |
| 6,831,541 | B1 | 12/2004 | Seidler | |
| 6,866,046 | B2 | 3/2005 | Gueret | |
| 6,926,151 | B1 | 8/2005 | Perry et al. | |
| 6,974,513 | B2 | 12/2005 | Kepka | |
| 7,162,802 | B2 * | 1/2007 | Benardeau et al. | 30/147 |
| 2001/0037815 | A1 | 11/2001 | Gueret | |
| 2002/0117423 | A1 | 8/2002 | Jackson | |
| 2004/0018037 | A1 | 1/2004 | Gueret | |
| 2004/0168700 | A1 * | 9/2004 | Dorf | 132/313 |
| 2005/0031401 | A1 | 2/2005 | Gueret | |
| 2005/0224392 | A1 | 10/2005 | Perry et al. | |
| 2007/0014624 | A1 | 1/2007 | Fogelson et al. | |
| 2007/0199575 | A1 | 8/2007 | Del Ponte | |
| 2008/0283083 | A1 | 11/2008 | Piao et al. | |
| 2010/0017990 | A1 | 1/2010 | Piao et al. | |

FOREIGN PATENT DOCUMENTS

| | | | |
|---|---|---|---|
| JP | 57-018414 | U | 1/1982 |
| JP | 2003-033228 | | 2/2003 |
| KR | 20-0432010 | Y | 11/2006 |
| WO | WO 2009/054918 | | 4/2009 |
| WO | WO 2010011273 | | 1/2010 |

OTHER PUBLICATIONS

Office Action dated Mar. 24, 2010, U.S. Appl. No. 11/702,475.

International Search Report and Written Opinion dated Mar. 26, 2009, Application No. PCT/US2008/011883.

Office Action dated Sep. 21, 2010, U.S. Appl. No. 11/702,475.

* cited by examiner

BRUSHES WITH INTERCHANGEABLE HEADS

CROSS REFERENCE TO RELATED APPLICATION

This application claims benefit of People's Republic of China Patent Application No. 200720096006.9, filed May 14, 2007.

BACKGROUND

Cosmetic brushes are the main applicators for people applying makeup. Different sorts of makeup require different brushes such as a lip brush, an eye shadow brush etc. In cosmetic applicators currently commercially available, one brush has only one function, so the user needs to buy a set of brushes to achieve a satisfactory makeup. A brush head on a normal brush can easily be damaged by frequent use, and may need to be replaced. However, it is wasteful to throw the brush handle and ferrule away when only the head of the brush is damaged.

To solve the above problem, a brush with a separate head and handle is currently available. However, the ferrule and handle are connected by a screw thread, and the brush has the following disadvantages. First, the connection is not very effective in insuring that the head stays firmly on the handle. Second, it takes time to assemble the brush handle into the ferrule when using. As a result, the above brush is not convenient enough for people's use in applying makeup.

SUMMARY

In accordance with an embodiment of the present invention, there is provided a brush kit having interchangeable heads that can provide a more reliable connection of the ferrule to the handle. In addition, this brush kit can serve various functions in applying makeup by providing various brush heads that are easily assembled onto the brush handle with a magnet.

In one embodiment of the invention, a brush kit comprises a brush head, a ferrule, and a brush handle. The brush is assembled with the head at one end of the ferrule, and the handle at the other end of the ferrule. There is a piece of magnet attached to at least one of the brush handle and the ferrule where the two parts connect.

The brush head may be inserted into a tubular handle. Alternatively, the brush handle inserted into a tubular ferrule attached to the brush head.

By providing magnets in both the handle and the ferrule, when the handle is inserted into the ferrule the handle can stay firmly engaged with the ferrule. This simple structure makes the brush easy to assemble, and thus saves people's time in brush head assembling.

A single brush handle can be assembled with various brush heads. Once the brush head is damaged, the user can just change the brush head instead of throwing the whole brush away.

The kit may comprise different handles that can be used with a single head, or different heads that can be used with a single handle. By interchanging different heads or handles, the user can be provided with the functionality of several different brushes without the cost and size of so many brushes. For example, a single handle with various brush heads can be put into a small cosmetic box or pouch to avoid contamination of the brush heads while at the same time providing a brush set that is convenient to take when traveling.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE DRAWINGS

Figure 1:
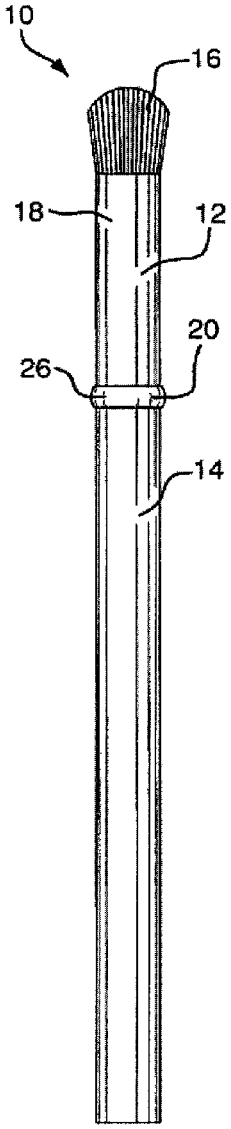
FIG. 1 is a front view of an assembled brush.
Figure 2:
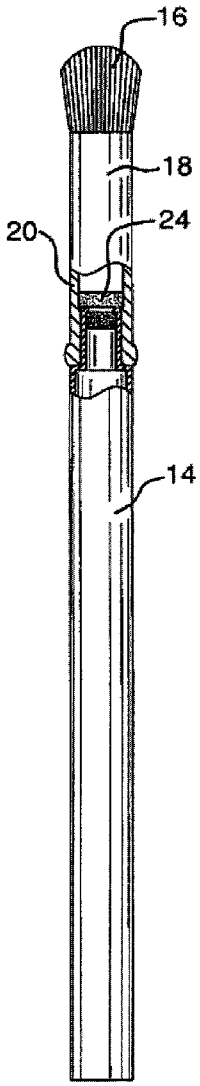
FIG. 2 is a cutaway view of the brush shown in FIG. 1.
Figure 3:
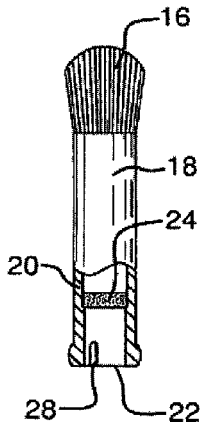
FIG. 3 is a cutaway view of a brush head and ferrule forming part of the brush shown in FIG. 1.

Reference will now be made in detail to various embodiments of the present invention, examples of which are illustrated in the accompanying drawings. The embodiments are described by way of explanation, and not by way of limitation.

Referring initially to FIGS. 1 to 4, one embodiment of a head-switchable brush indicated generally by the reference numeral 10 comprises a brush head assembly 12 and a brush handle 14. The brush head assembly 12 comprises a head 16 comprising bristles or the like, a ferrule 18, and an insert sleeve 20. The sleeve 20 is open at the end 22 facing away from the head 16, and a first magnet 24 is mounted inside the sleeve, a short distance from the open end. In the embodiment, the ferrule 18 holds the bristles 16 in a conventional manner, and is bonded to the exterior of the sleeve 20 so that the head 16, ferrule 18, sleeve 20, and second magnet 34 form, from the user's point of view, a permanent assembly 12.

In the embodiment, the ferrule 18 is formed from anodized aluminum or other material with a decorative appearance. The insert sleeve 20 is formed from ABS or other moldable plastic. The ferrule 18 may cover the entire exterior of the sleeve 20 but in the embodiment shown in FIG. 1, the rim 26 of the sleeve 20 is left visible to form a decorative feature. The rim 26 projects to form a bead against which the ferrule 18 seats, and covers the edge of the ferrule, which may be thin and sharp. The bead 26 may also assist in retaining the brush head assembly 12 in a pouch or other container, reducing damage to the head 16 in transport, and reducing the risk of contamination from contact between heads 16 used for different cosmetics. Different brushes 12 in a set may be made with sleeves 20 of different colors. The visible rims 26 of the sleeves 20 may then assist in distinguishing different brushes in a kit, as well as forming a decorative feature.

One or more shallow grooves 28 may be molded into the inner surface of the sleeve 20, extending for a short distance starting at the open end 22. In an embodiment, three grooves 28 are provided, evenly spaced around the circumference of the open end 22.

Figure 4:
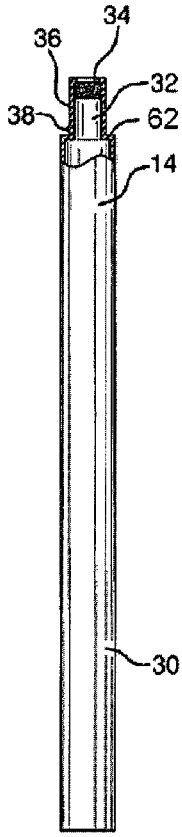
FIG. 4 is a cutaway view of a brush handle forming part of the brush shown in FIG. 1.
Figure 5:
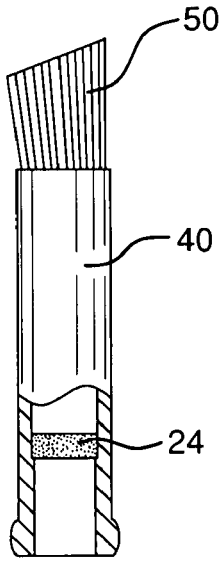
FIG. 5 to FIG. 10 are views similar to FIG. 3 showing alternative forms of brush heads usable with the handle shown in FIG. 4.
Figure 6:
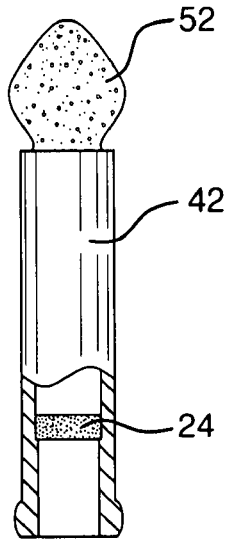
Figure 7:
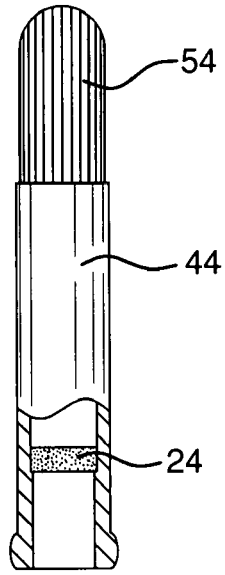
Figure 8:
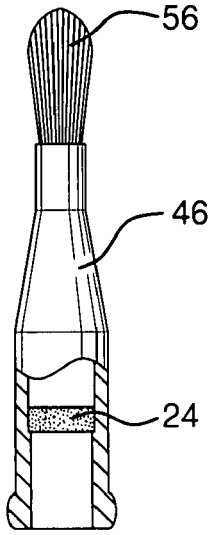
Figure 9:
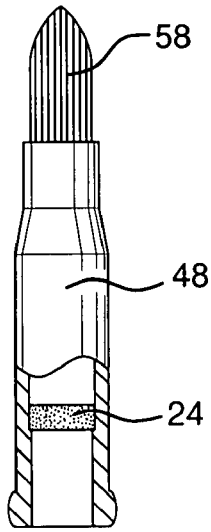

Referring now especially to FIG. 4, the handle 14 comprises a handle body 30 that is sized and shaped for convenient holding by the user. As shown in the drawings, the handle body, is cylindrical, about 100 mm (4") long and about 8 mm (⅓") in diameter, but other shapes and sizes may be used. At one end, the handle body 30 has a narrower peg 32 projecting. The handle body 30 may be molded in a single piece including the peg 32. The tip of the peg 32 carries a second magnet 34, which is held in place by a cap 36 of aluminum or other non-magnetic material that fits over the peg 32. The cap 36 may have a closed end that conceals the magnet 34, or may have an open end surrounded by a lip that wraps over the end of the magnet 34 sufficiently to retain the magnet.

The peg 32, including the cap 36, is dimensioned so as to fit snugly into the interior of the sleeve 20, and so that the tip end of the cap 36 bottoms against the first magnet 24 just before the bead 26 bottoms against a shoulder 62 formed between the peg 32 and the handle body 30. The first and second magnets 24, 34 are then close together, separated only by the thickness of the cap 36, which may be as thin as 0.25 mm (0.01") or even less. The magnets are oriented so that they are attracted to each other in that position. For example, the magnets may both be magnetized with their polar directions in the same direction parallel to the axes of the sleeve 20 and the peg 32.

Figure 10:
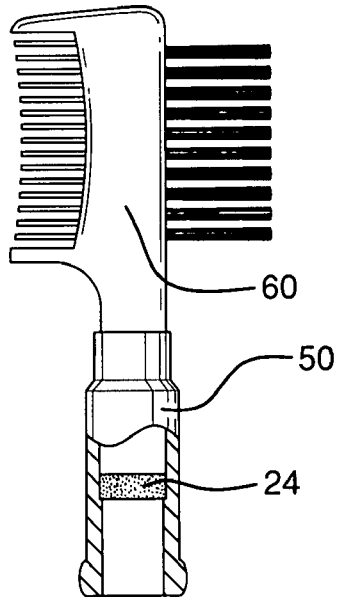

One or more projecting dots 38, matching in number and spacing the grooves 28 in the head 12, may be formed in the side wall of the cap 36. The dots 38 and grooves 28 are dimensioned so that when the brush head assembly 12 is mounted on the handle 14 the dots 38 seat in the grooves 28, and restrain the brush head assembly 12 from rotating about the longitudinal axis of the sleeve 20 and the peg 32. This is especially useful with (see FIG. 10) a brush head assembly 50 (see FIG. 10) that is designed to be used with a sideways motion. The mouths of the grooves 28 may be widened to form funnels that guide the dots 38 into the grooves 28, but that is believed not to be necessary. In a practical embodiment, it has been found that either the user rotates the head assembly 12 and the handle 14 until the grooves 28 align with the dots 38, or the user forces the dots 38 onto the lands between the grooves 28. In the latter case, either the dots create an interference fit sufficient to restrain the head assembly 12 against rotation, or the head assembly 12 rotates until the dots 38 snap into the grooves 28.

Referring to FIGS. 5 to 10, different head assemblies 40, 42, 44, 46, 48, 50 may be provided for different purposes within the overall process of applying make-up. The brushes may have different heads 50, 52, 54, 56, 58, 60 as shown. Suitable heads may include brush heads of various shapes, including those shown at 16, 50, 54, 56, and 58, a sponge applicator 52, a brush and comb 60, and other applicators or tools used in the process of applying make-up or otherwise attending to one's personal appearance.

Alternatively, some or all of the head assemblies 50, etc. may have substantially identical heads 60, etc., but may be used for applying different cosmetic materials, including cosmetic materials of different colors, to avoid contamination of the materials by using the same brush or other applicator for more than one material. Alternatively, some of the brush head assemblies 12 may be of similar shapes but of different materials, for example, one brush may be stiffer than another. In these cases, differently colored rims 26 may be particularly helpful to the user.

Each of the head assemblies 40, 42, 44, 46, 48, 50 has a sleeve 20 and a first magnet 24 identical to those of the head assembly 12.

Figure 11:
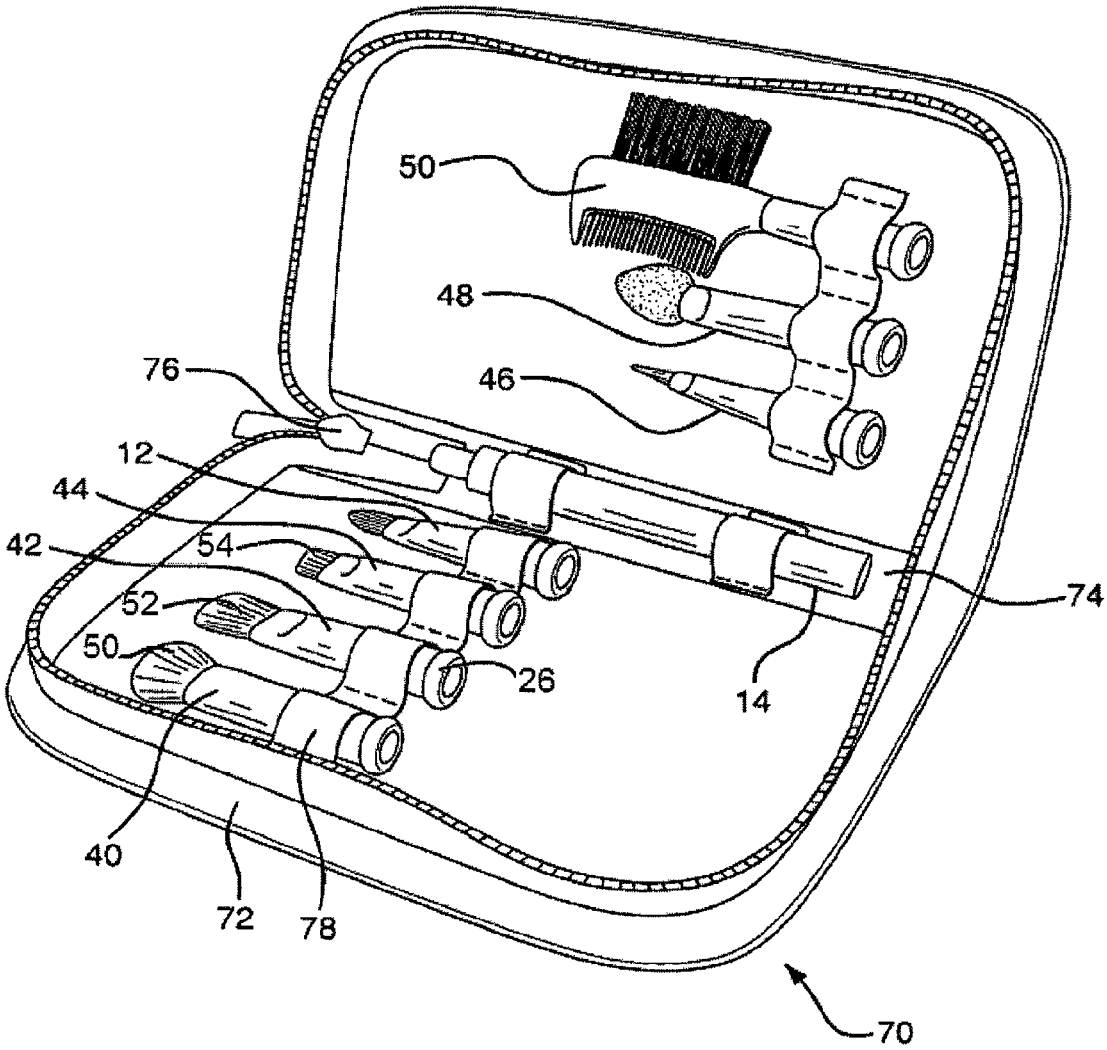
FIG. 11 is a perspective view of a first kit of brushes in a wallet.

Referring now to FIG. 11, a second embodiment of a cosmetic application kit comprises a wallet or pouch 72. As shown in FIG. 11, the wallet 72 opens at a central spine 74, and can be closed by a zip-fastener 76 along the edges. However, other configurations, including configurations known in the art, may be used.

The wallet 72 includes a handle 14, and several head assemblies 40, 42, 44, 12, 46, 48, 50. As shown in FIG. 11, the handle 14 is positioned along the spine of the wallet 72, and the head assemblies are mounted in two rows, in a top half of the wallet on one side of the spine 74, and in a bottom half of the wallet on the other side of the spine 74. The head assemblies 40, etc. are thus well spaced, allowing easy access when the wallet 72 is open, while allowing a very compact arrangement when the wallet is closed, because the head assemblies in each side fit into empty space in the other side.

As shown in FIG. 11, the handle 14 and the heads 40, etc, are held in place with elastic straps 78. As may be seen in FIG. 11, the beads 26 engage the straps 78, retaining the head assemblies secure and stably in position, and reducing any tendency for adjacent heads 50, etc, to rub against one another and contaminate each other with different cosmetic materials.

In use, the user takes the handle 14 from the wallet 72. The user selects one of the head assemblies and takes that from the wallet. The user inserts the peg 32 of the handle 14 into the open end 22 of the selected head assembly. The thick, rounded bead 26 of the sleeve 20 assists in inserting the peg 32 into the open end 22. Once the peg 32 is sufficiently inserted into the sleeve 20, the magnets 24, 34 attract each other, and pull the head assembly and the handle 14 tightly together. The user then uses the brush 10 with the selected head assembly to apply cosmetics or otherwise tend to his or her personal appearance, including doing so in a known manner. The magnetic connection, unlike a screw connection, does not tend to come loose even if the side of the brush is used in a stroking motion that imposes a turning force on the head.

When the user has finished using the brush 10, the user can easily remove the head assembly 12, 40, etc. from the handle 14 by a sharp pull, and replace the head assembly in the wallet 72. The user may then select a different head assembly, and use that in the same manner described above, or may replace the handle 14 in the wallet 72 and close the wallet.

Figure 12:
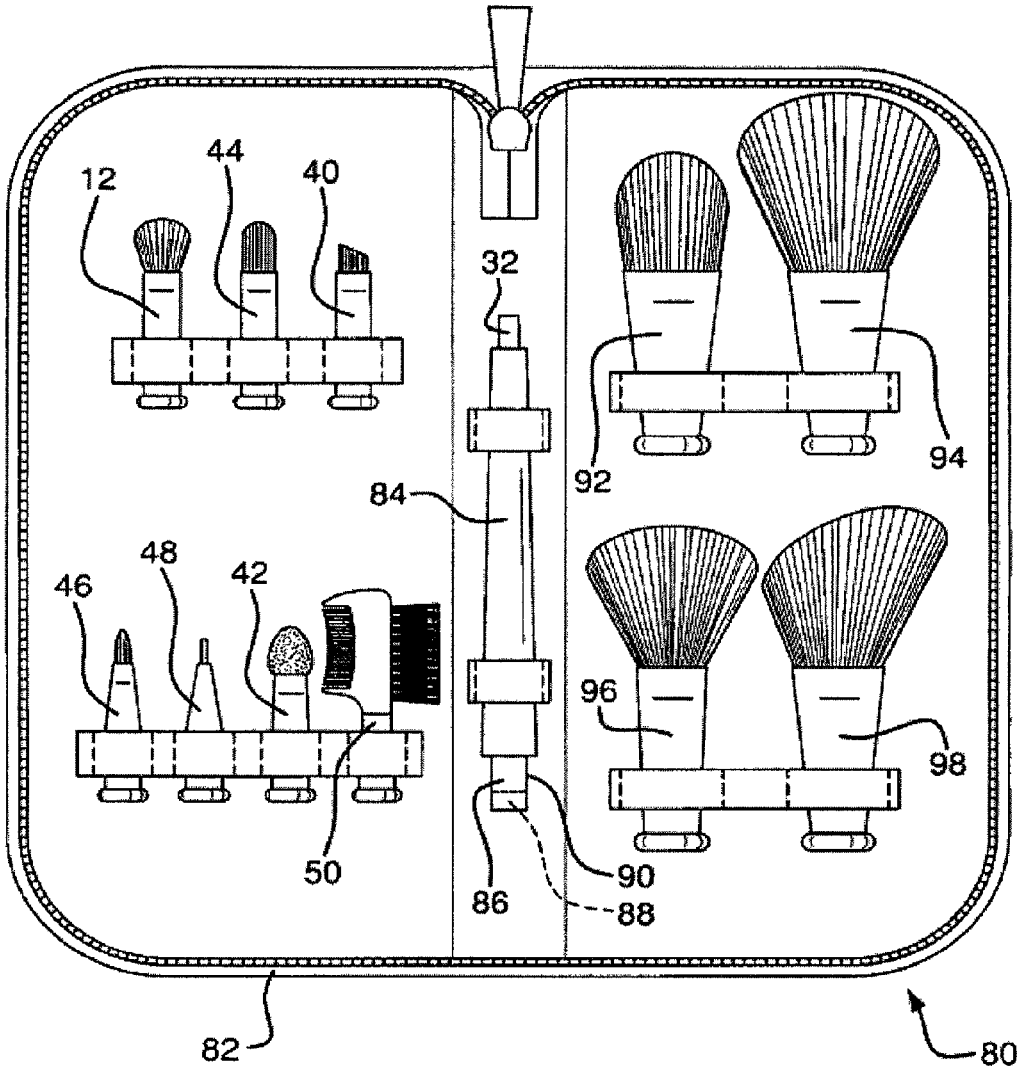
FIG. 12 is a perspective view of a second kit of brushes in a wallet.

Referring now to FIG. 12, a second embodiment of a cosmetic application kit 80 comprises a wallet or pouch 82, similar in general construction to, but larger than, the wallet 72 shown in FIG. 11.

The wallet 82 includes a handle 84 that is tapered from end to end. The handle 84 has a peg 32 with a magnet 34 and cap 36, similar to those shown in FIG. 4, at the narrow end. At the wider end, the handle 84 has a peg 86, with a cap 90 and magnet 88, of similar construction but larger size. As shown in FIG. 12, the handle 84 is positioned along the spine of the wallet 82. On one side of the spine, the wallet 82 contains a set of head assemblies that may be identical to the set of head assemblies 40, 42, 44, 12, 46, 48, 50 shown in FIG. 11, mounted in two rows. These head assemblies are sized to fit onto the peg 32, as described with reference to FIG. 11. On the other side of the spine, the wallet 82 contains a set of head assemblies 92, 94, 96, 98 that are similar in construction, but are sized to fit onto the larger peg 86.

The handle 84 and the heads 40, etc. are held in place with elastic straps 78 similar to those shown in FIG. 11. The use of the kit 80 is similar to that of the kit 70 shown in FIG. 11. However, the user of the kit 80 may choose either a large brush head assembly 92, 94, 96, 98 or a small brush head assembly 40, 42, 44, 12, 46, 48, 50, and mounts the chosen brush head assembly on the appropriate end of the handle 84. The large brush head assemblies are typically used for applying foundation, blusher, or other cosmetics that cover a comparatively large area, and the small brush head assemblies are typically used for applying cosmetics to smaller areas.

When the user has finished using the brush 10, the user can easily remove the head assembly 12, 40, etc. from the handle 14 by a sharp pull, and replace the head assembly in the wallet 72. The user may then select a different head assembly, and use that in the same manner described above, or may replace the handle 14 in the wallet 72 and close the wallet.

As an example of suitable dimensions, the peg 32 may be about 5 mm in diameter and 8.5 mm long, measured over the outside of the cap 36. The peg 32 may be tapered so as to be 0.75 mm narrower at the tip than at the base, so as to assist insertion into the ferrule. The dots 38 may be around 0.75 mm high. The recess in the sleeve 20 may be a few tenths of a millimeter wider than the base of the peg 32. The peg 86 may be about 9 mm in diameter and 14 mm long, measured over the outside of the cap 90. The magnetic pulling force between the magnetic elements 24 and 34, when the peg 32 is fully inserted into the head assembly 12, may be around 0.6 lb in a typical example. Forces within the range of from about 0.4 lbf to about 1.2 lbf have been found acceptable. Considerable variation within the acceptable range has been found to be acceptable, both between the brushes of a set and between different sets. For the large brush head assemblies 92, etc., a pulling force in the range of from 0.4 or 0.45 lbf to 2 lbf has been found to be acceptable.

Various modifications and variations can be made in the present invention without departing from the spirit or scope of the invention. Thus, it is intended that the present invention cover the modifications and variations of this invention provided they come within the scope of the appended claims and their equivalents.

For example, the head assemblies 12, 40, etc, have been shown as comprising first magnets 24 and the handle has been shown as comprising a second magnet 34. Alternatively, one of the components 24, 34 could be a magnet, and the other of those components could be a piece of magnetizable iron or steel or other magnetizable material. In the embodiment shown in FIG. 11, the single handle 14 may have a second magnet 34, and the multiple head assemblies 12, 40, etc. may have first magnets 24 in the form of magnetizable steel disks. In the embodiment shown in FIG. 12, the single handle 84 may have second magnets 34, 88, and the multiple head assemblies 12, 40, etc. may have first magnets 24 in the form of magnetizable steel disks. Alternatively, different configurations may be used for the head assemblies 92, 94, 96, 98 sized to fit the wide end from the head assemblies 12, 44, 40, 46, 48, 42, 50 sized to fit the narrow end if a stronger magnetic coupling is desired at one end than the other.

For example, in FIGS. 3 and 5 to 10, the sleeve 20 is shown extending towards the head beyond the first magnet 24. Depending on whether the sleeve 20 is providing reinforcement for the ferrule 18, the sleeve may end at the magnet 24 or may continue towards the head end of the ferrule.

For example, the kit 70 shown in FIG. 11 has one handle 14 and several head assemblies 12, 40, etc. Alternatively, two or more handles 14, which may be the same or different, may be provided. Alternatively, a single head may be used with different handles, for example, to allow different manners of using the single head.

The kit 70 has been described primarily as a system to allow interchanging of different handles. Alternatively, or in addition, the brushes described may be used to enable replacement of damaged, worn, or otherwise unsuitable heads without the waste of discarding an entire brush.

As shown in the drawings, the head assembly 12, etc, has a ferrule 18 with a hollow end 22 that receives a peg 32 on an end of the handle 14. Alternatively, the handle 14 could be provided with a recess that receives a peg on the end of the ferrule 18.

What is claimed is:

1. A head-switchable cosmetic applicator, comprising:

a head assembly including a ferrule having: (a) a first generally planar mating surface formed at least in part by a first magnetic element and (b) one of a recess or a projection; and a handle including: (a) a second generally planar mating surface formed at least in part by a second magnetic element and (b) the other of the recess or the projection;

wherein the recess is non-magnetic and capable of receiving the projection;

wherein at least one of the first and second magnetic elements is a magnet, and the head assembly is releasably attachable to the handle by magnetic attraction between the first and second magnetic elements creating a pulling force between about 0.4 lbf to about 1.2 lbf when the head assembly and the handle are attached; and wherein the part of the first generally planar mating surface formed by the first magnetic element and the part of the second generally planar mating surface formed by the second magnetic element are in flush alignment when the head assembly and the handle are attached; wherein the projection and the recess have longitudinal axes that align when the head assembly and the handle are attached, wherein one of the projection and the recess comprises at least one axially extending groove, and wherein the other of the projection and the recess comprises at least one protuberance positioned to engage in the at least one groove to restrain the head assembly from rotation relative to the handle about the aligned axes.

2. The head-switchable applicator according to claim 1, wherein one of the first magnetic element or the second magnetic element is on the projection and the other of the first magnetic element or the second magnetic element is in the recess.

3. The head-switchable applicator according to claim 1, wherein the first and second magnetic elements are both permanent magnets, and are oriented so as to attract one another when the handle and the head assembly are assembled together.

4. The head-switchable applicator according to claim 1, further comprising at least one additional head assembly including a ferrule and a first magnetic element, and wherein the additional head assembly is releasably attachable to the handle by magnetic attraction between the first and second magnetic elements when the additional head assembly and the handle are attached.

5. The head-switchable applicator according to claim 1, wherein the handle further comprises a third magnetic element to which a second head assembly including a ferrule and a fourth magnetic element is releasably attachable and the head assembly including the first magnetic element is not attachable.

6. The head-switchable applicator according to claim 5, wherein one of the head assembly including the first magnetic element and the handle comprises a first recess, and the other of said head assembly and the handle comprises a first projection insertable into the first recess; wherein one of the second head assembly and the handle comprises a second recess, and the other of the second head assembly and the handle comprises a second projection insertable into the recess; wherein the first and second magnetic elements are on the first projection and in the first recess; and wherein the third and fourth magnetic elements are on the second projection and in the second recess.

7. A head-switchable cosmetic applicator, comprising:

a male component having: (a) a non-magnetic projection on a distal end of the male component and (b) a first magnetic element forming at least part of a distal-most generally planar surface of the male component; and a female component having: (a) a non-magnetic recess adapted to receive the projection in a forward end of the female component to form a mated configuration with the male component and (b) a second magnetic element positioned to be in flush alignment with the first magnetic element in the mated configuration;

wherein one of the male component or the female component is a head assembly including a ferrule and the other of the male component or the female component is a handle; and wherein at least one of the first and second magnetic elements is a magnet, and the head assembly is releasably attachable to the handle by magnetic attraction between the first and second magnetic elements creating a pulling force between about 0.4 lbf to about 1.2 lbf in the mated configuration; wherein one of the projection or the recess comprises one or more protuberances positioned circumferentially with respect to a longitudinal axis and spaced inwardly from the distal end of the projection or the open end of the recess, respectively; and wherein the other of the projection or the recess comprises one or more grooves extending proximally from adjacent the distal end of the projection or from adjacent the open end of the recess, respectively, the projection being insertable into the recess a first distance until the one or more protuberances meet a non-grooved portion of the open end of the recess or a non-grooved portion of the projection if the protuberances and grooves are not aligned, and being insertable farther into the recess upon rotation of one or both of the components until the one or more protuberances align with corresponding one or more grooves, the male and female components being restrained from rotating about the longitudinal axis relative to one another when the one or more protuberances engage the one or more grooves.

8. The head-switchable applicator according to claim 7, wherein the distal-most generally planar surface is at the distal end of the projection and the second magnetic element is in the recess.

9. The head-switchable applicator according to claim 7, further comprising at least one additional male component, wherein the male component is a head assembly including a ferrule, and wherein the additional male component is releasably attachable to the female component by magnetic attraction between the first and second magnetic elements in the mated configuration.

10. A cosmetic applicator assembly comprising a male component and a female component releasably attachable to one another, wherein:

said female component includes a first magnetic element and a recess defining an open end thereof, and the male component includes a second magnetic element and a projection defining a distal end, the projection being insertable into the recess; and an applicator element positioned on the male component or the female component;

wherein the first and second magnetic elements are positioned so that they hold the female and male components releasably together when the projection is inserted into the recess;

wherein one of the projection or the recess comprises one or more protuberances positioned circumferentially with respect to a longitudinal axis and spaced inwardly from the distal end of the projection or the open end of the recess, respectively; and wherein the other of the projection or the recess comprises one or more grooves extending proximally from adjacent the distal end of the projection or from adjacent the open end of the recess, respectively, the projection being insertable into the recess a first distance until the one or more protuberances meet a non-grooved portion of the open end of the recess or a non-grooved portion of the projection if the protuberances and grooves are not aligned, and being insertable farther into the recess upon rotation of one or both of the components until the one or more protuberances align with corresponding one or more grooves, the male and female components being restrained from rotating about the longitudinal axis relative to one another when the one or more protuberances engage the one or more grooves;

wherein the pulling force between said first magnetic element and said second magnetic element when said arrangement of one or more protuberances is engaged by said arrangement of one or more grooves is between about 0.4 lbf to about 1.2 lbf.

11. The cosmetic applicator assembly according to claim 10, wherein each of the one or more protuberances is a plurality of projecting dots dimensioned to be seated in one of said one or more grooves.

12. The cosmetic applicator assembly according to claim 11, wherein each groove of said one or more grooves is tapered such that an open end width of a first end of said groove coinciding with said open end of the recess is greater than a second width of a second end of said groove.

13. The cosmetic applicator assembly according to claim 10, wherein the pulling force between said first magnetic element and said second magnetic element when said arrangement of one or more protuberances is engaged by said arrangement of one or more grooves is between about 0.4 lbf to about 2.0 lbf.

14. The cosmetic applicator assembly according to claim 10, wherein the male component is a handle including the projection and the female component is a brush head including the recess.

15. The cosmetic applicator assembly according to claim 10, wherein the male component is a brush head including the projection and the female component is a handle including the recess.

16. A method of equipping a first component including a projection with a removable attachment including a recess, comprising the steps of:

inserting the projection into the recess;

after partially inserting the projection into the recess, aligning an arrangement of protuberances positioned circumferentially around a longitudinal axis of and spaced inwardly from an end of the projection or the recess with an arrangement of grooves formed in the recess or on the projection, said protuberances following said grooves to guide said projection to a non-rotational seated position within the recess; and releasably maintaining said seated position by way of a pulling force in the range of about 0.4 lbf to about 1.2 lbf between a primary magnetic element in the recess and a secondary magnetic element associated with the projection.

17. The method of claim 16, further comprising:

releasably maintaining said projection within said recess by said pulling force after said partial insertion and prior to aligning the protuberances with the grooves.

* * * * *